US012055031B2

(12) United States Patent
Sun et al.

(10) Patent No.: US 12,055,031 B2
(45) Date of Patent: Aug. 6, 2024

(54) MONITORING DRILLING VIBRATIONS BASED ON ROTATIONAL SPEED

(71) Applicant: Halliburton Energy Services, Inc., Houston, TX (US)

(72) Inventors: Zhijie Sun, Spring, OK (US); Ketan C. Bhaidasna, Houston, TX (US); Ganesh Ramakrishnan, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 490 days.

(21) Appl. No.: 17/369,597

(22) Filed: Jul. 7, 2021

(65) Prior Publication Data

US 2023/0010614 A1 Jan. 12, 2023

(51) Int. Cl.
*E21B 44/04* (2006.01)
*E21B 3/02* (2006.01)

(52) U.S. Cl.
CPC ..... *E21B 44/04* (2013.01); *E21B 3/022* (2020.05); *E21B 2200/20* (2020.05); *E21B 2200/22* (2020.05)

(58) Field of Classification Search
CPC ..... E21B 44/04; E21B 3/022; E21B 2200/20; E21B 2200/22; E21B 47/007; E21B 44/00
See application file for complete search history.

(56) References Cited

U.S. PATENT DOCUMENTS 6,065,332 A * 5/2000 Dominick ..... G01H 1/10 73/152.43
9,689,250 B2 6/2017 Badkoubeh et al.
10,415,364 B2 9/2019 Kyllingstad
10,458,223 B2 10/2019 Badkoubeh et al.
10,995,605 B2 5/2021 Sun et al.
11,156,075 B2 * 10/2021 Ramakrishnan ..... E21B 3/02
2012/0228028 A1 9/2012 Turner et al.
2014/0360779 A1 * 12/2014 Kyllingstad ..... E21B 44/00 175/24

(Continued)

FOREIGN PATENT DOCUMENTS

EP 3464808 A1 * 4/2019 ..... E21B 44/00

OTHER PUBLICATIONS

Pacas, J.M., John, A. and Eutebach, T., D. Dec. 2000, Automatic identification and damping of torsional vibrations in high-dynamic-drives. In ISIE'2000. Proceedings of the 2000 IEEE International Symposium on Industrial Electronics (Cat. No. 00TH8543) (vol. 1, pp. 201-206). IEEE. (Year: 2000).*

*Primary Examiner* — Alicia M. Choi
(74) *Attorney, Agent, or Firm* — Benjamin Ford; Parker Justiss, P.C.

(57) ABSTRACT

The disclosure provides a solution for monitoring stick-slip vibrations without using any surface torque measurements. Instead, the disclosure provides a method to monitor stick-slip vibrations based on rotational speed. A stick-slip monitor, a top drive controller and a method of operating a drill string are provided herein that use rotational speed for monitoring stick-slip vibrations. In one example, the method of operating a drill string includes: (1) performing a frequency domain analysis of an RPM signal associated with a top drive that is used to rotate a drill string, and (2) determining a presence of torsional oscillations of the drill string based on the frequency domain analysis of the RPM signal.

19 Claims, 4 Drawing Sheets

(56) References Cited

U.S. PATENT DOCUMENTS

| | | | | |
|---|---|---|---|---|
| 2015/0105912 | A1* | 4/2015 | Dykstra | E21B 47/00 700/275 |
| 2015/0247416 | A1* | 9/2015 | Flodgaard | F02D 29/02 415/121.3 |
| 2016/0245067 | A1 | 8/2016 | Haci et al. | |
| 2019/0211665 | A1* | 7/2019 | Zha | E21B 44/08 |
| 2019/0257153 | A1* | 8/2019 | Badkoubeh | E21B 44/04 |
| 2019/0368332 | A1* | 12/2019 | Sun | E21B 44/04 |
| 2020/0003611 | A1 | 1/2020 | Turner et al. | |
| 2020/0040720 | A1* | 2/2020 | Zalluhoglu | E21B 7/04 |
| 2020/0157928 | A1* | 5/2020 | Ramakrishnan | E21B 3/02 |
| 2020/0332652 | A1* | 10/2020 | Sehsah | E21B 47/01 |

* cited by examiner

MONITORING DRILLING VIBRATIONS BASED ON ROTATIONAL SPEED

BACKGROUND

Accessing a gas or oil well involves creating a wellbore by drilling into the earth using a drill bit. The drill bit is located at the downhole end of a drill string that includes multiple drill pipes connected together. A top drive is used at the surface of the wellbore to turn the drill string, which rotates the drill bit and extends the wellbore into the earth. A top drive controller is typically used in the drilling industry to maintain a set rotational speed for the top drive.

In drilling systems, a cyclic variation of the bit speed, which can range from zero to multiple times the rotational speed set at the top drive, is commonly referred to as stick-slip vibration. The torsional oscillations associated with stick-slip vibration are detrimental to the integrity of the drilling system and can result in, for example, drill string fatigue, bottom hole assembly (BHA) damage, and bit wear. The torsional oscillations can also be delimiters of optimum performance, which includes high rate of penetration (ROP) and minimal nonproductive time.

SUMMARY

In one aspect, the disclosure provides a method of operating a drill string. In one example the method includes: (1) performing a frequency domain analysis of an RPM signal associated with a top drive that is used to rotate a drill string, and (2) determining a presence of torsional oscillations of the drill string based on the frequency domain analysis of the RPM signal.

In another aspect, the disclosure provides a stick-slip monitor for drilling systems. In one example, the stick-slip monitor includes: (1) an interface configured to receive RPM signals associated with a top drive that is used to rotate a drill string, and (2) a processor configured to change the RPM signals by iteratively modifying one or more control parameters of a top drive controller and determine a presence of torsional oscillations of the drill string based on a frequency domain analysis of the RPM signals.

In yet another aspect the disclosure provides a top drive controller. In one example, the top drive controller includes: (1) a speed controller configured to control RPMs of a top drive used to rotate a drill string, and (2) a processor configured to automatically change the RPM signals, perform a frequency domain analysis on the RPM signals, and determine a presence of torsional oscillations of the drill string and a frequency thereof based on the frequency domain analysis of the RPM signals.

BRIEF DESCRIPTION

Reference is now made to the following descriptions taken in conjunction with the accompanying drawings, in which.

DETAILED DESCRIPTION

Figure 1:
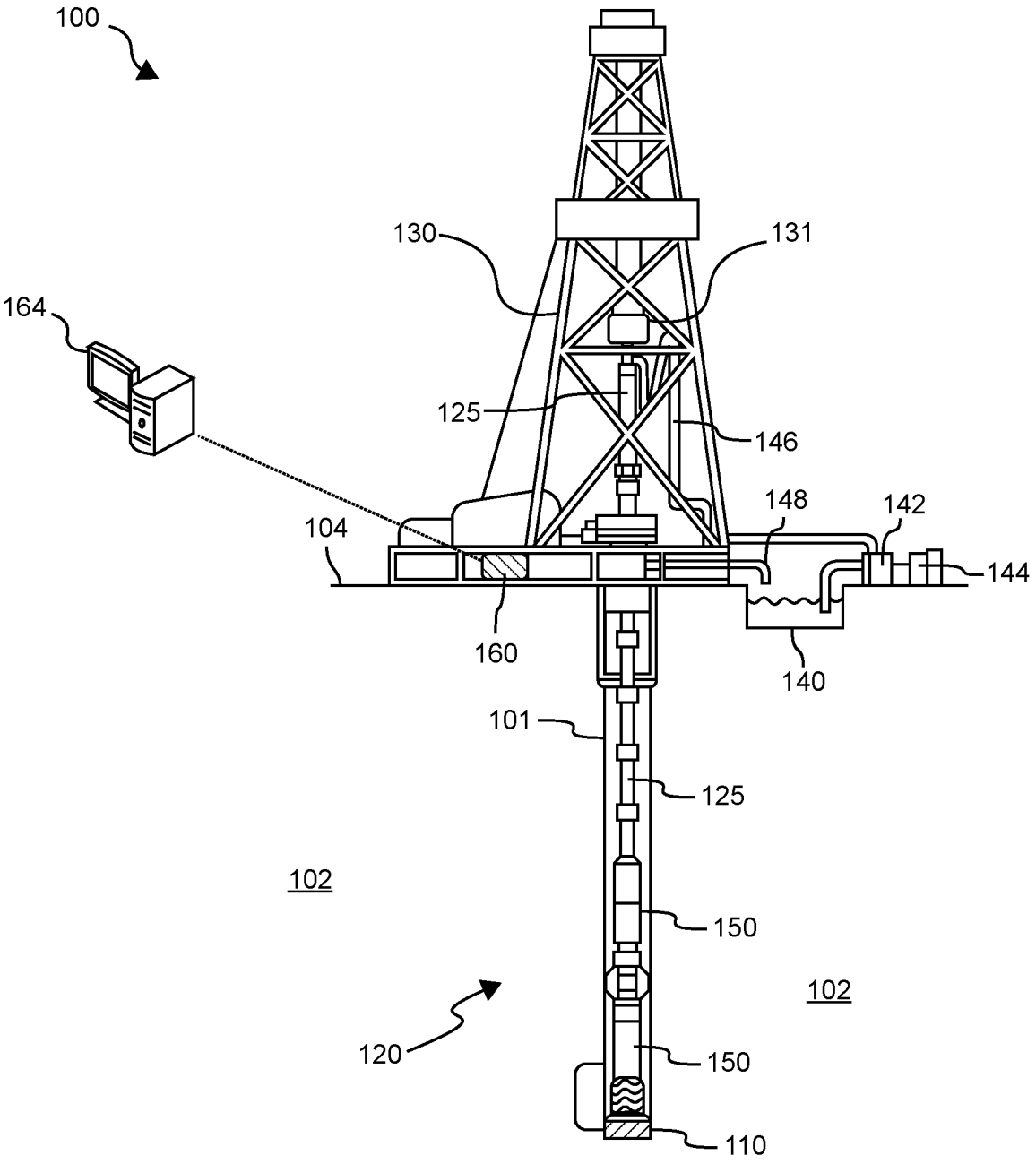
FIG. 1 illustrates a system diagram of an example of a logging while drilling (LWD) system configured to perform formation drilling to create a wellbore according to the principles of the disclosure.

Various techniques in the drilling industry use reaction torque of a drill string at the surface for estimating downhole stick-slip behavior. For example, either motor torque of the top drive or pipe torque of the drill string are often used to determine stick-slip vibration and frequencies. The torque by the top drive motor and the reaction torque from the drill string are represented in the below equations.

The dynamics of a top drive that rotates a drill string can be represented by the following governing equation, Equation 1:

$$j\dot{\tau}(t)=\tau_d(t)-\tau_c(t) \tag{1}$$

where $\omega$ is the angular velocity of the top drive, $\tau_d$ and $\tau_c$ are the torque by the top drive motor and the reaction torque from the drill string, respectively. J is the equivalent top drive inertia which includes the inertia of motor and gears.

Taking the Laplace transform on both sides of Equation 1 results in Equation 2:

$$Js\Omega=T_d-T_c \tag{2}$$

where s is a complex number in frequency domain, and $\Omega$, $T_d$, and $T_c$ are the Laplace transform of variables $\omega$, $\tau_d$ and $\tau_c$, respectively.

The top drive torque $\tau_d$ (or $\tau_d$) is usually controlled by a measured revolutions-per-minute (RPM) $\omega$ (or $\Omega$) in a variable frequency drive (VFD) of the top drive controller. By denoting the transfer function of a top drive controller as), Equation 2 becomes Equation 3 that results in Equation 4 when solving for RPM $\Omega$:

$$Js\Omega = -C\Omega - T_c \tag{3}$$

$$\Omega = -\frac{1}{Js + C} \cdot T_c \tag{4}$$

The default speed controller in a VFD typically has a very large steady-state gain, which results in a small magnitude of $$-\frac{1}{Js + C}$$

for all frequencies.

As noted above, it is known in the drilling industry that the reaction torque $\tau_c$ (or $\tau_c$) can be a good indicator of stick-slip severity. As such, vibrations in RPM $\Omega$ may have a small amplitude, which can make it difficult to monitor stick-slip vibrations using a top-drive RPM with default settings. Accordingly, a torque sensor is typically required to obtain torque measurements for determining the presence of stick-slip vibrations of a drill string. A torque sensor, however, may not be available at a drilling site and even if available is an additional cost for the operator.

Advantageously, the disclosure provides a solution for monitoring stick-slip vibrations without using any surface torque measurements. Instead, the disclosure provides a method to monitor stick-slip vibrations based on the rotational speed of the top drive, such as angular velocity RPM $\Omega$ represented hereinafter by RPM, and by changing the transfer function C of the top drive controller. As disclosed herein, the top drive controller can be iteratively modified within the operating limits of the top drive controller and the resulting RPM signal used to determine stick-slip vibrations. Accordingly, a torque sensor, such as at the surface, is not needed to determine the presence of stick-slip vibrations. Additionally, when stick-slip vibrations exist, the one or more frequencies of the torsional oscillations can also be determined without the need for torque measurements. Once stick-slip is observed, various existing methods to mitigate stick-slip can then be used.

The disclosure provides a method, apparatus, and system for monitoring stick-slip vibrations based on surface rotational speed. The stick-slip, therefore, can be observed using only rotational information, such as the RPM, of the drill string at the surface. Thus, the disclosed method allows operators of a drilling rig to monitor and mitigate stick-slip vibration with existing hardware and sensors that are typically used at a drilling site. A higher ROP and better trajectory control for a drilling operation can result.

As noted above, the disclosure provides an iterative technique for modifying the operation of a top drive controller and determining stick-slip vibration based on the rotational speed of a drill string. In addition to angular velocity (RPM), angular displacement (angular position) and/or angular acceleration are examples of other signals of rotational information that can be obtained for rotational speed. Angular displacement may be measured by an encoder and angular acceleration may be measured by micro-electro-mechanical-systems (MEMS) based sensors.

Figure 2:
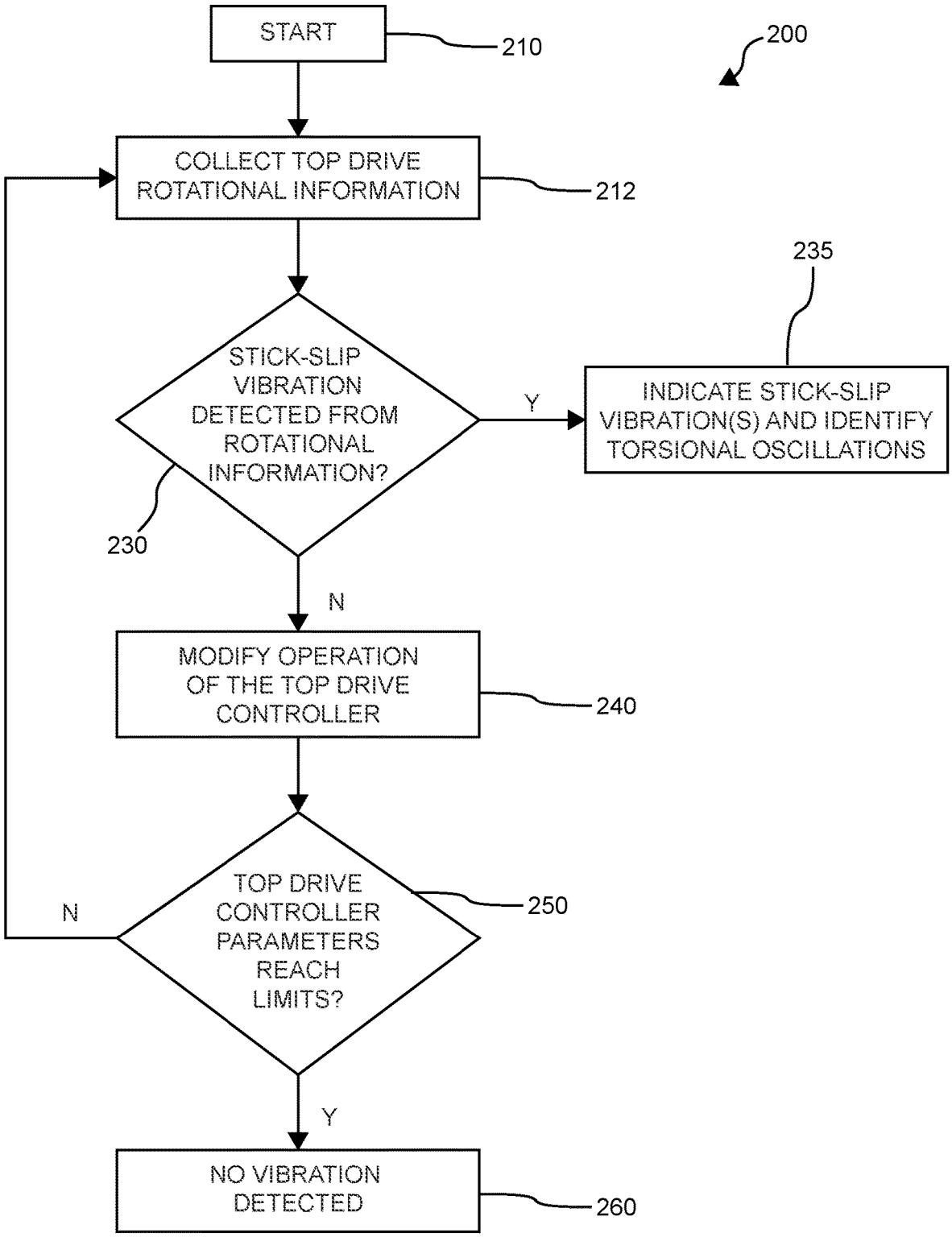
FIG. 2 illustrates a flow diagram of an example of a method of operating a drill string carried out according to the principles of the disclosure.

The logic for one example of stick-slip monitoring as disclosed herein is illustrated in the flow diagram of FIG. 2. The logic can represent an algorithm and can reside in a stick-slip monitor or a top drive controller such as mentioned in FIG. 1.

FIG. 1 illustrates a logging while drilling (LWD) system 100 configured to perform formation drilling to create a wellbore 101. The LWD system 100 includes a BHA 120 that includes a drill bit 110 that is operatively coupled to a tool string 150, which may be moved axially within the wellbore 101. During operation, the drill bit 110 penetrates the earth 102 and thereby creates the wellbore 101. BHA 120 provides directional control of the drill bit 110 as it advances into the earth 102. Tool string 150 can be semi-permanently mounted with various measurement tools (not shown) such as, but not limited to, measurement-while-drilling (MWD) and logging-while-drilling (LWD) tools, that may be configured to take downhole measurements of drilling conditions and geological formation of the earth 102.

The LWD system 100 is configured to drive the BHA 120 positioned or otherwise arranged at the bottom of the drill string 125 extended into the earth 102 from a derrick 130 arranged at the surface 104. The LWD system 100 includes a top drive 131 that is used to rotate the drill string 125 at the surface 104, which then rotates the drill bit 110 in the wellbore 101. Operation of the top drive 131 is controlled by a top drive controller. The LWD system 100 can also include a kelly and a traveling block that is used to lower and raise the kelly and drill string 125.

Fluid or "drilling mud" from a mud tank 140 may be pumped downhole using a mud pump 142 powered by an adjacent power source, such as a prime mover or motor 144. The drilling mud may be pumped from mud tank 140, through a stand pipe 146, which feeds the drilling mud into drill string 125 and conveys the same to the drill bit 110. The drilling mud exits one or more nozzles arranged in the drill bit 110 and in the process cools the drill bit 110. After exiting the drill bit 110, the mud circulates back to the surface 104 via the annulus defined between the wellbore 101 and the drill string 125, and in the process, returns drill cuttings and debris to the surface. The cuttings and mud mixture are passed through a flow line 148 and are processed such that a cleaned mud is returned down hole through the stand pipe 146 once again.

The LWD system 100 also includes a well site controller 160, and a computing system 164, which can be communicatively coupled to well site controller 160. Well site controller 160 includes a processor and a memory and is configured to direct operation of the LWD system 100.

Well site controller 160 or computing system 164, can be utilized to communicate with downhole tools of the tool string 150, such as sending and receiving telemetry, data, drilling sensor data, instructions, and other information, including but not limited to collected or measured parameters, location within the borehole 101, and cuttings information. A communication channel may be established by using, for example, electrical signals or mud pulse telemetry for most of the length of the tool string 150 from the drill bit 110 to the controller 160.

Figure 3:
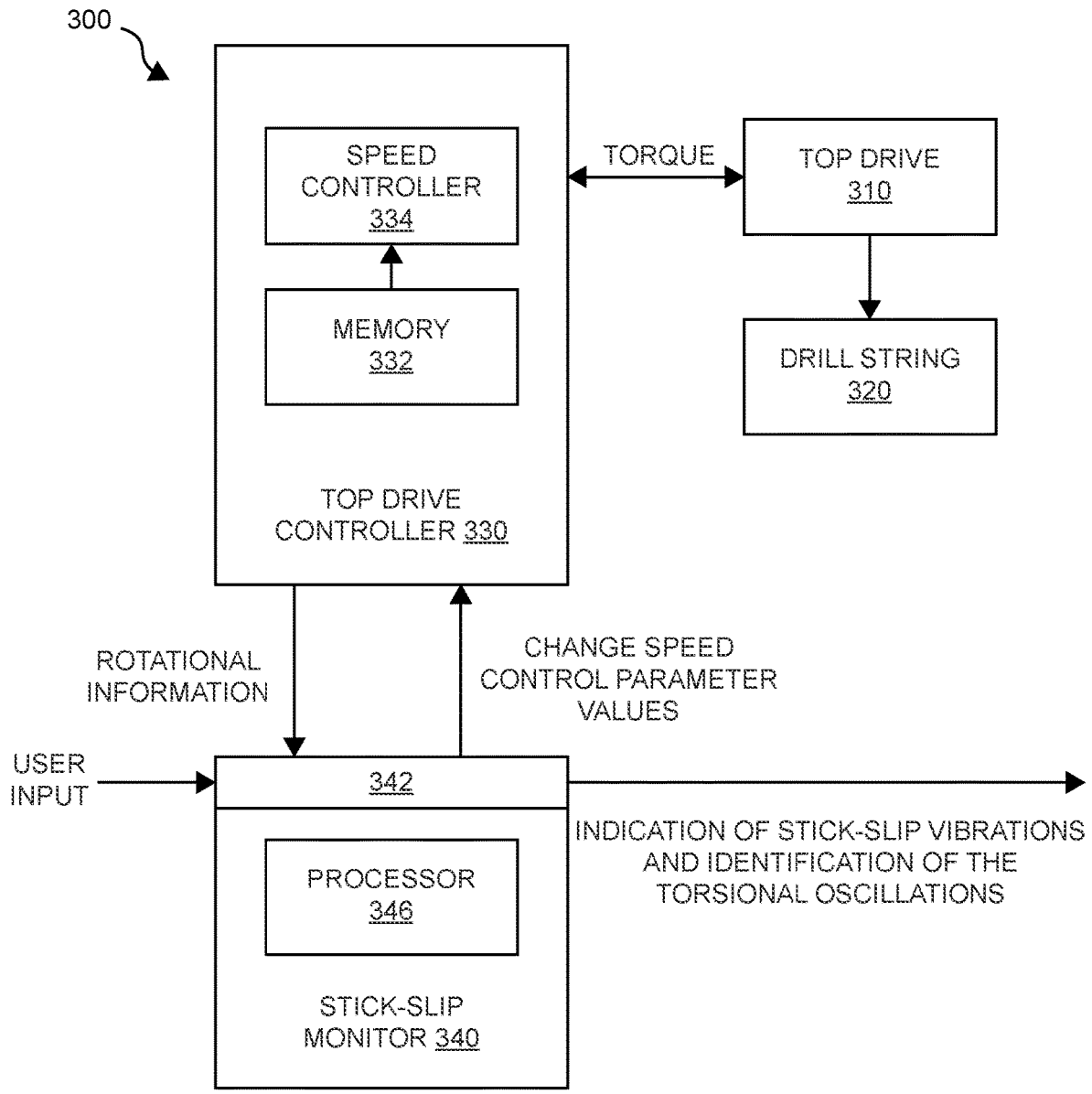
FIG. 3 illustrates a block diagram of an example of a drilling system constructed according to the principles of the disclosure.
Figure 4:
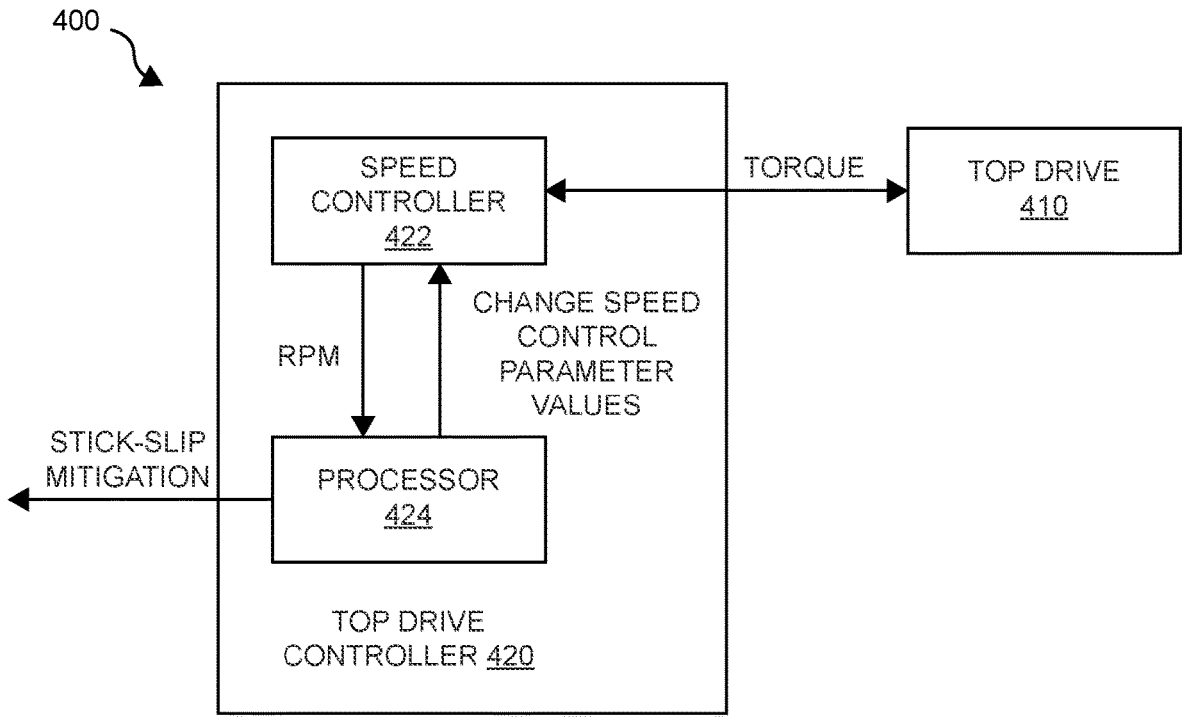
FIG. 4 illustrates a block diagram of another example of a drilling system constructed according to the principles of the disclosure.

The controller 160, or a separate computing device such as computing system 164, can be configured to perform one or more of the functions of the top drive controller and/or a stick-slip monitor such as illustrated in FIGS. 3 and 4. For example, the controller 160, the computing system 164, or a combination thereof can be configured to determine stick-slip vibrations and frequencies of the torsional oscillations using the rotational information of the top drive 131. Computing system 164 can be proximate well site controller 160 or be distant, such as in a cloud environment, a data center, a lab, or a corporate office. Computing system 164 can be a laptop, smartphone, personal digital assistant (PDA), server, desktop computer, cloud computing system, other computing systems, or a combination thereof, that are operable to perform the processes and methods described herein. Well site operators, engineers, and other personnel can send and receive data, instructions, measurements, and other information by various conventional means with computing system 164 or well site controller 160. Regardless the implementing device or location, the top drive controller communicates controls to the top drive 131 via a conventional wired or wireless communication medium.

FIG. 2 illustrates a flow diagram of an example of a method 200 of operating a drill string carried out according to the principles of the disclosure. The method 200 represents an algorithm that monitors stick-slip vibrations using rotational information of a drill string. The method 200 provides an iterative process that intentionally changes the rotational speed, such as the RPM of a top drive, during a drilling operation and advantageously identifies stick-slip vibrations without requiring torque measurements. At least some of the steps of the method 200 can be performed by a stick-slip monitor as disclosed herein.

The method 200 can be automatically or manually initiated. The method 200 can be periodically initiated during a drilling operation wherein the drill string is rotated by the top drive. The time interval between initiations can be static or can vary during operation of the top drive. A duration of the method 200 once initiated can be for a predetermined amount of time and can also be static or variable during operation of the top drive. The periodic time intervals and the duration can be based on various factors, including but not limited to drilling depth, formation information, drill bit data, historical data from previous drilling operations, current drilling data, or a combination of these or other factors. As noted, an operator can also manually initiate the method 200. The manual initiation can be based on suspected stick-slip. Even when automated, an operator can still manually initiate the method 200 when stick-slip is suspected. Regardless of automatic or initial initiation, the steps of the method 200 can be performed automatically once started. The method 200 begins in step 210 after drilling in a wellbore has already started.

In step 212, rotational information of a top drive is collected. The rotational information can be RPM data obtained from a top drive controller that controls operation of the top drive. The RPM data can also be obtained by measuring the RPM of the top drive. The rotational information can be an RPM electrical signal that is received in real time and indicates the current RPM of the top drive. The rotational information can be provided to a stick-slip monitor for additional processing. Angular displacement and angular acceleration are other examples of rotational information that can be obtained. An RPM signal will be used as an example for method 200.

In decisional step 230, a determination is made from the RPM signal if stick-slip vibration is present on the drill string based on the rotational information. In contrast to other methods in the drilling industry, determining the presence of stick-slip vibrations can be done without requiring torque measurements. A frequency domain analysis can be conducted on the rotational information to detect the presence, or not, of stick-slip vibration. For example, the frequency domain analysis can be used to obtain the frequency spectrum of an RPM signal. The frequency domain analysis can include performing a fast Fourier transform (FFT) of the RPM signal. Peaks in the FFT of the RPM signal can be used to indicate stick-slip behavior at the frequency of the peak or peaks. The peaks can be an eminent peak that has a value greater than a threshold over the FFT. The threshold value can be predetermined based on, for example, empirical data, or can be calculated during processing of the RPM signal to insure, for example, compensating for noise. Peaks can also be detected using well-known tools, such as the find_peaks function from the scientific computation library Scientific Python (SciPy) that finds peaks inside a signal based on peak properties. Other known functions can also be used that, for example, take a 1-D array and finds all local maxima by comparison of neighboring values.

Instead of a FFT, the frequency domain analysis could be an auto-correlation analysis of the RPM signal. With the auto-correlation analysis, stick-slip vibrations can also be detected via peaks at one or more frequencies of torsional oscillations. Accordingly, an auto-correlation analysis can be used to find the frequency of repeating patterns, which are the torsional oscillations.

When detecting the presence of the stick-slip vibration from the rotational information, the method 200 continues to step 235 where an indication of stick-slip vibration is provided. As noted above, the presence of stick-slip vibration can coincide with peaks of the FFT. In addition to the indication of the presence of stick-slip vibration, the torsional oscillations associated with the stick-slip vibrations can also be identified. The torsional oscillations can be identified, for example, by frequency or amplitude. The indication can be provided via one or more ways including providing a visual indication, an audible indication, or a combination of both. The indications of stick-slip vibration and identification of torsional oscillations can be provided via, for example, at least one of the well site controller 160 or the computing device 164 of FIG. 1. The indication and identification can be provided to a system for mitigating the stick-slip vibrations.

Returning to step 230, if stick-slip vibration is not detected, the method 200 continues to step 240 wherein operation of the top drive controller is modified. For example, considering FFT, if an eminent peak is not detected then the method 200 continues to step 240. Modifying the operation can include modifying one or more of the control parameters of the top drive controller to change the RPM of the top drive.

The control parameters modified can be coefficients of transfer function C of the top drive controller, such as represented in Equation 4. For example, the amplitude of the transfer function C in a given frequency band, typically 0-1 Hz, can be reduced to increase the value of $$\left|\frac{1}{Js + C}\right|$$

such that vibration signature is $T_c$ can be better revealed in Ω. Such modification can be done by reducing the steady-state gain of the top drive controller, which may reduce |Js+C| for low-frequency band, which is typically 0-1 Hz.

In some examples, the top drive controller is a proportional-integral-derivative (PID) controller. For modifying the top drive controller, the proportional, integral and/or derivative gain may be changed simultaneously such that |Js+C| is reduced for a specific frequency or frequency band of torsional oscillations. As such, the proportional or integral derivative can be decreased.

Instead of a PID controller, the top drive controller could also use an electric current controller that can be manipulated to change the amplitude of the RPM. Other methods may also include controlling magnetic flux to change the RPM.

After the modifying, the method 200 continues to decisional step 250 where a determination is made if one or more of the control parameters of the top drive controller have reached their limits. The limits for the control parameters can be predetermined and can be based on the physical drilling system, such as represented in FIG. 1. A comparison between the predetermined limits and the values of the control parameters can be used to determine if a limit has been reached. If one or more of the limits have been reached, the method 200 continues to step 260 and ends with no stick-slip vibration detected. For example, if the steady-state gain reaches its lower bound and there is still no peak detected, there is little or no stick-slip vibration and the method ends in step 260. The method 200 can be automatically or manually restarted during the drilling operation as noted above.

If the control parameters have not reached their limits, the method 200 continues to step 212 and repeats. At this point, a change in the RPM of the top drive should be reflected in the newly collected rotational information. The method 200 then continues in search for stick-slip vibration.

For example, the rotational information collected in step 212 can indicate a top drive RPM of 100 and no stick-slip vibration detected in step 230. In step 240, control parameters of the top drive can be modified to cause an RPM change of the top drive to 98. If the control parameters have not met their limit, the rotational information is collected again in step 212 that reflects the RPM change to 98. A determination is then made in step 230 if there is stick-slip vibration using this new RPM of 98. If not, the RPM is intentionally changed again, such as to 101, by changing the control parameters and the method 200 continues to step 250 to check if a limit has been reached based on the newly changed control parameters. The iterative changes continue until stick-slip vibration is detected and reported in step 235 or until limits for the control parameters have been reached without stick-slip vibration detected in step 260.

FIG. 3 illustrates a block diagram of an example of a drilling system 300 constructed according to the principles of the disclosure. The drilling system 300 includes a top drive 310, a drill string 320, a top drive controller 330, and a stick-slip monitor 340. Typically, a BHA (not illustrated in FIG. 3) is coupled to the drill string 320 as represented in FIG. 1. The top drive 310 rotates the drill string 320 that in turn rotates a drill bit (not shown in FIG. 3) within a wellbore. The top drive 310 and the drill string 320 can be conventional components of a drilling system typically employed in the industry.

The top drive controller 330 controls the operation of the top drive 310 and can employ control parameter values provided by the stick-slip monitor 340 to change the RPM of the top drive 310. The top drive controller 330 includes a memory 332 and a speed controller 334. The memory 332 stores computer executable instructions and the speed controller 334 controls the RPM of the top drive 310. In one example, the memory 332 stores instructions that, when executed, perform the function of the speed controller 334 for the top drive 310. As such, the speed controller 334 can be implemented on a processor that employs the operating instructions from the memory 332. The speed controller 334 can include a proportional-integral (PI) controller such as employed in typical top drive speed controllers. The speed controller 334 can employ speed control parameter values provided by the stick-slip monitor 340 to change the RPM of the top drive 310. The top drive controller 330 and the stick-slip monitor 340 are shown as separate and distinct from the top drive 310 and from each other. In some examples, the top drive 310, the top drive controller 330, and the stick-slip monitor 340 or at least two of these can be integrated together in a single device, or at least located proximate one another.

The stick-slip monitor 340 includes an interface 342 and a processor 346. The interface 342 is configured to communicate data, i.e., transmit and receive data. Accordingly, the interface 342 includes the necessary logic, ports, terminals, etc., to communicate data. As illustrated, the interface 342 can receive feedback data from the top drive controller 330 that includes rotational information of the top drive 310. The rotational information can be received in real time and indicate the current RPM of the top drive 310. The rotational information can be obtained from the speed controller 334 or can be measured from the top drive 310. The rotational information can be obtained and transmitted to the stick-slip monitor 340 via conventional methods used with a drilling system.

The processor 346 is configured to iteratively modify control parameters of the top drive controller 330 to change the RPM of the top drive 310. The processor 346 can modify the control parameter values, or at least one of the control parameter values of the top drive controller 330 during operation of the top drive 310. The processor 346 can automatically modify the control parameter values. For example, the processor 346 can periodically initiate modifying the control parameter values. The time intervals can be static or can vary during the operation of the top drive 310. An operator can also manually initiate modifying via the interface 342 using a user interface, such as a keyboard, a touch pad, a touch screen, a mouse, an audible command, etc. The processor 346 can be configured to allow an operator to manually initiate the modifications based on, for example, suspected stick-slip, even when configured for automatic operation. The control parameters modified by the processor 346 can be coefficients of transfer function C of the top drive controller 330, such as represented in Equation 4. For example, the steady-state gain of transfer function C can be reduced by 10%.

The processor 346 is further configured to indicate stick-slip vibrations and identify associated torsional oscillations based on the RPM of the top drive 310. The torsional oscillations can be identified via, for example, frequency or amplitude. The processor 346 can identify torsional oscillations at more than one frequency. The processor 346 can monitor for stick-slip vibrations according to the method 200.

FIG. 4 illustrates a block diagram of another example of a drilling system 400 constructed according to the principles of the disclosure. As with the drilling system 300, the drilling system 400 determines stick-slip vibrations and identifies torsional oscillations based on rotational information of a top drive. Additionally, the drilling system 400 is configured to use the identified torsional oscillations to target specific frequencies or narrow range of frequencies for mitigation. For example, the drilling system 400 uses the information provided in step 235 of method 200 to operate a top drive controller. An example of a narrow range is +/−0.1 Hz. By identifying the torsional oscillations from the rotational information as disclosed herein, the drilling system 400 is configured to target specific torsional oscillation frequencies and perform mitigation measures that are specific for and independently applied to each of the frequencies or each narrow frequency range. The drilling system 400 can continually mitigate stick-slip vibrations through the drilling process. The drilling system 400 includes a top drive 410 and a top drive controller 420.

The top drive 410 is configured to rotate a drill string in a wellbore, such as top drive 131 or 310 of FIGS. 1 and 3. The top drive controller 420 is configured to control the operation of the top drive 410. As such, the top drive controller 420 can include features of the top drive controller 330 of FIG. 3. In contrast to conventional top drive controllers that are directed to maintaining a constant RPM for a top drive, the top drive controller 420 is configured to intentionally change the RPM of the top drive 410 to determine torsional oscillation frequencies due to stick-slip vibrations and use the frequency information to continually mitigate stick-slip vibrations of the drill string. The top drive controller 420 includes a speed controller 422 and a processor 424.

The speed controller 422 controls the RPM of the top drive 410. As with the speed controller 334, the speed controller 422 can include a memory that stores instructions that cause a processor to perform the functions of the speed controller 422 for the top drive 410. As such, the speed controller 334 can be implemented on a processor, such as processor 424, that employs the operating instructions from the memory. The speed controller 422 can control the RPM of the top drive 410 by, for example, changing the torque applied to the top drive 410.

The processor 424 is configured to determine stick-slip vibrations based on top drive rotational information and identify the one or more frequencies of torsional oscillations associated with the stick-slip vibrations. The processor 424 can determine the stick-slip vibrations and frequencies according to the method 200. Through continual changes to the RPM of the top drive, the processor 432 can determine torsional oscillations of the drill string at multiple frequencies and automatically mitigate each of the torsional oscillations independently.

Accordingly, the processor 424 can be configured to target specific torsional oscillation frequencies and independently use a specific mitigation technique for each of the distinct torsional oscillation frequencies. The processor 424 can automatically mitigate against the torsional oscillations by changing control parameters of the top drive controller 420 or by enacting one or more other mitigation procedures known in the industry for each of the different torsional oscillations.

For example, the processor 424 can change speed controller parameters, i.e., the values of the speed controller parameters, to mitigate torsional oscillations of the drill string. The processor 424 can enact one or more of the mitigation procedures itself and/or can provide the stick-slip vibration and frequency information to a mitigation system to perform at least some of the mitigation. U.S. Pat. No. 10,995,605 to Halliburton Energy Services provides an example of a known mitigation system or procedure.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured means, for example, designed, constructed, or programmed, with the necessary logic and/or features for performing a task or tasks. A configured device, therefore, is capable of performing the task or tasks. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of aspects disclosed in the Summary can have one or more of the following additional elements in combination.

Element 1: further comprising changing the RPM signal by iteratively modifying one or more control parameters of a top drive controller, and repeating the performing and determining. Element 2: further comprising limiting the modifying of the top drive controller based on operating limits of the control parameters of the top drive controller. Element 3: wherein the performing and the determining are automatically initiated during operation of the top drive. Element 4: wherein the providing and the determining are manually initiated during operation of the top drive. Element 5: further comprising identifying the torsional oscillations. Element 6: wherein the frequency domain analysis includes performing a fast Fourier transform (FTT) and the determining the presence of the torsional oscillations is based on detecting a peak in an amplitude of the FFT of the RPM signal. Element 7: wherein the frequency domain analysis includes performing an auto-correlation analysis and the determining the presence of the torsional oscillations is based on detecting a peak in an amplitude of the auto-correlation analysis of the RPM signal. Element 8: wherein the top drive controller is a proportional-integral-derivative (PID) controller. Element 9: further comprising mitigating the torsional oscillations. Element 10: wherein the processor limits the iteratively modifying based on operating limits of the control parameters of the top drive controller. Element 11: wherein the processor is configured to automatically change the RPM signals and automatically determine the presence of torsional oscillations during operation of the top drive. Element 12: wherein the processor is further configured to identify a frequency of the torsional oscillations. Element 13: wherein the processor is configured to perform the frequency domain analysis via a fast Fourier transform (FTT) of the RPM signals and determine the presence of the torsional vibrations by detecting a peak in an amplitude of the FFT of the RPM signal. Element 14: wherein the processor is further configured to automatically mitigate the torsional oscillations by changing speed control parameters of the speed controller. Element 15: wherein the processor is configured to determine torsional oscillations of the drill string at multiple frequencies and automatically mitigate each of the torsional oscillations independently. Element 16: wherein the processor limits the modifying of the RPMs of the top drive controller based on limits of one or more control parameters of the top drive controller. Element 17: wherein the frequency domain analysis includes performing a fast Fourier transform (FTT) and the determining the presence of the torsional oscillations is based on detecting a peak in an amplitude of the FFT of the RPM signal.

What is claimed is:

1. A method of operating a drill string, comprising:

performing a frequency domain analysis of an RPM signal associated with a top drive that is used to rotate a drill string;

determining a presence of torsional oscillations of the drill string based on the frequency domain analysis of the RPM signal; and mitigating the torsional oscillations based on the determining by modifying control parameters of a proportional-integral (PI) controller of a top drive controller controlling the drill string, wherein the control parameters are coefficients of a transfer function C of the top drive controller.

2. The method as recited in claim 1, further comprising changing the RPM signal by iteratively modifying one or more control parameters of a top drive controller, and repeating the performing and determining.

3. The method as recited in claim 2, further comprising limiting the modifying the one or more control parameters of the top drive controller based on operating limits of the one or more control parameters of the top drive controller.

4. The method as recited in claim 1, wherein the performing and the determining are automatically initiated during operation of the top drive.

5. The method as recited in claim 1, wherein the performing and the determining are manually initiated during operation of the top drive.

6. The method as recited in claim 1, further comprising identifying the torsional oscillations.

7. The method as recited in claim 1, wherein the frequency domain analysis includes performing a fast Fourier transform (FTT) and the determining the presence of the torsional oscillations is based on detecting a peak in an amplitude of the FFT of the RPM signal.

8. The method as recited in claim 1, wherein the frequency domain analysis includes performing an auto-correlation analysis and the determining the presence of the torsional oscillations is based on detecting a peak in an amplitude of the auto-correlation analysis of the RPM signal.

9. The method as recited in claim 1, wherein the top drive controller is a proportional-integral-derivative (PID) controller.

10. A stick-slip monitor for drilling systems, comprising:

an interface configured to receive RPM signals associated with a top drive that is used to rotate a drill string; and a processor configured to change the RPM signals by iteratively modifying one or more control parameters of a proportional-integral controller of a top drive controller controlling the drill string and determine a presence of torsional oscillations of the drill string based on a frequency domain analysis of the RPM signals, wherein the torsional oscillations are mitigated by the modified control parameters and the control parameters are coefficients of a transfer function C of the top drive controller.

11. The stick-slip monitor as recited in claim 10, wherein the processor limits the iteratively modifying based on operating limits of the one or more control parameters of the top drive controller.

12. The stick-slip monitor as recited in claim 10, wherein the processor is configured to automatically change the RPM signals and automatically determine the presence of torsional oscillations during operation of the top drive.

13. The stick-slip monitor as recited in claim 10, wherein the processor is further configured to identify a frequency of the torsional oscillations.

14. The stick-slip monitor as recited in claim 10, wherein the processor is configured to perform the frequency domain analysis via a fast Fourier transform (FTT) of the RPM signals and determine the presence of the torsional oscillations by detecting a peak in an amplitude of the FFT of the RPM signals.

15. A top drive controller, comprising:

a speed controller configured to control RPM signals a top drive used to rotate a drill string; and a processor configured to:

automatically change the RPM signals, perform a frequency domain analysis on the RPM signals, determine a presence of torsional oscillations of the drill string and a frequency thereof based on the frequency domain analysis of the RPM signals; and mitigate the torsional oscillations based on the determining by modifying control parameters of a proportional-integral (PI) controller of a top drive controller controlling the drill string, wherein the control parameters are coefficients of a transfer function C of the top drive controller.

16. The top drive controller as recited in claim 15, wherein the processor is further configured to automatically mitigate the torsional oscillations by changing speed control parameters of the speed controller.

17. The top drive controller as recited in claim 16, wherein the processor is configured to determine torsional oscillations of the drill string at multiple frequencies and automatically mitigate each of the torsional oscillations independently.

18. The drilling system as recited in claim 15, wherein the processor limits the modifying of the RPMs of the top drive controller based on limits of one or more control parameters of the top drive controller.

19. The drilling system as recited in in claim 15, wherein the frequency domain analysis includes performing a fast Fourier transform (FTT) and the determining the presence of the torsional oscillations is based on detecting a peak in an amplitude of the FFT of the RPM signals.

* * * * *